US008874013B2

(12) United States Patent
Aoki

(10) Patent No.: US 8,874,013 B2
(45) Date of Patent: Oct. 28, 2014

(54) IMAGE FORMING APPARATUS, AND METHOD FOR TRANSFERRING COLOR TONER IMAGES

(71) Applicant: Shinji Aoki, Kanagawa (JP)

(72) Inventor: Shinji Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 13/645,764

(22) Filed: Oct. 5, 2012

(65) Prior Publication Data

US 2013/0121734 A1 May 16, 2013

(30) Foreign Application Priority Data

Nov. 14, 2011 (JP) ..... 2011-248732

(51) Int. Cl.
*G03G 15/01* (2006.01)
*G03G 15/16* (2006.01)

(52) U.S. Cl.
CPC ..... *G03G 15/0189* (2013.01); *G03G 15/1675* (2013.01); *G03G 2215/0129* (2013.01)
USPC ..... 399/299; 399/66; 399/302

(58) Field of Classification Search
USPC ..... 399/66, 145, 297, 298, 299, 300, 302, 399/305, 314, 301
See application file for complete search history.

(56) References Cited

U.S. PATENT DOCUMENTS 5,758,038 A * 5/1998 Itoh et al.
6,658,220 B2 * 12/2003 Bessho et al. ..... 399/44
8,238,773 B2 * 8/2012 Usami et al. ..... 399/66
8,346,111 B2 * 1/2013 Maehata et al. ..... 399/66
2003/0156863 A1 * 8/2003 Takayanagi ..... 399/296
2004/0179860 A1 * 9/2004 Watanabe et al.
2009/0123168 A1 5/2009 Aoki et al.
2010/0098446 A1 4/2010 Ishikawa et al.
2010/0232820 A1 * 9/2010 Usami et al. ..... 399/66

(Continued)

FOREIGN PATENT DOCUMENTS

JP 2002031935 A * 1/2002
JP 2003-186284 7/2003

(Continued)

OTHER PUBLICATIONS

English Machine Translation (Abstract, Claims, Detailed Description, Description of Drawings and Drawings) Iida, Jan. 2002, JP 2002031935 A.*

*Primary Examiner* — David Gray
*Assistant Examiner* — Travis Harper
(74) *Attorney, Agent, or Firm* — Harness, Dickey & Pierce, P.L.C.

(57) ABSTRACT

In an image forming apparatus, in which color toner images are primarily transferred to an intermediate transfer medium, and then secondarily transferred to a recording sheet at a secondary transfer nip, a secondary transfer current output device applies a transfer current to the transfer nip while determining the transfer current based on area ratios of the toner images using an algorithm. When determining the transfer current, the secondary transfer current output device estimates the target value of a transfer current needed for transferring one of the toner images to be not lower than that needed for transferring another toner image, which is primarily transferred next to the one of the toner images, and the target value of a transfer current needed for transferring a first toner image, which is primarily transferred firstly, to be lower than that needed for transferring a last toner image, which is primarily transferred lastly.

16 Claims, 5 Drawing Sheets

(56) References Cited

U.S. PATENT DOCUMENTS

| | | | |
|---|---|---|---|
| 2010/0284705 | A1 | 11/2010 | Aoki et al. |
| 2011/0058831 | A1 | 3/2011 | Usami et al. |
| 2011/0200348 | A1 | 8/2011 | Aoki |
| 2011/0255892 | A1 | 10/2011 | Aoki |
| 2012/0045231 | A1 | 2/2012 | Ogino et al. |
| 2012/0045237 | A1 | 2/2012 | Aoki et al. |
| 2012/0045259 | A1 | 2/2012 | Nakamura et al. |
| 2012/0213535 | A1* | 8/2012 | Harashima |
| 2012/0224873 | A1 | 9/2012 | Aoki |
| 2012/0230715 | A1 | 9/2012 | Ogino et al. |
| 2012/0237234 | A1 | 9/2012 | Sugimoto et al. |
| 2012/0243892 | A1 | 9/2012 | Nakamura et al. |
| 2012/0275808 | A1* | 11/2012 | Mochizuki ..... 399/66 |

FOREIGN PATENT DOCUMENTS

| | | | |
|---|---|---|---|
| JP | 2007-121619 | | 5/2007 |
| JP | 2007241117 A | * | 9/2007 |
| JP | 2010-191088 | | 9/2010 |

* cited by examiner

IMAGE FORMING APPARATUS, AND METHOD FOR TRANSFERRING COLOR TONER IMAGES

CROSS-REFERENCE TO RELATED APPLICATIONS

This patent application is based on and claims priority pursuant to 35 U.S.C. §119 to Japanese Patent Application No. 2011-248732, filed on Nov. 14, 2011 in the Japan Patent Office, the entire disclosure of which is hereby incorporated herein by reference.

FIELD OF THE INVENTION

The present invention relates to an image forming apparatus. Particularly, the present invention relates to an image forming apparatus, which has an intermediate transfer belt, and a nip forming member contacted with the intermediate transfer belt to form a transfer nip therebetween and in which a transfer current is flown through the transfer nip while changing the transfer current depending on the image area ratio. In addition, the present invention also relates to a method for transferring color toner images.

BACKGROUND OF THE INVENTION

Image forming apparatuses, which form images using an intermediate transfer method including forming a toner image on an image bearing member such as photoreceptors, primarily transferring the toner image onto an intermediate transfer medium, and secondarily transferring the toner image onto a recording sheet, are well known. By using an elastic material having good flexibility for the intermediate transfer medium, the adhesion between the recording sheet and the toner image can be enhanced.

Image forming apparatuses using such an intermediate transfer method typically include four photoreceptors which serve as image bearing members and on which yellow (Y), magenta (M), cyan (C), and black (K) toner images are respectively formed, and an endless intermediate transfer belt which makes endless movement while being contacted with the four photoreceptors to form primary transfer nips at which the Y, M, C and K toner images are sequentially transferred from the photoreceptors to the intermediate transfer belt so that the color toner images are overlaid, resulting in formation of a combined color toner image on the intermediate transfer belt. The combined color toner image on the intermediate transfer belt is then secondarily transferred onto a recording sheet, which is timely fed to a secondary transfer nip formed by the intermediate transfer belt and a transfer roller.

In such image forming apparatuses, since the amount (weight) of toners constituting the combined color toner image is considerably large, the combined color toner image cannot be satisfactorily transferred onto a recording sheet (resulting in formation of an image having a low image density) unless a large secondary transfer current is applied to the secondary transfer nip. In this regard, if a larger amount of secondary transfer current than that needed for transferring a toner image is applied, discharge is caused between the recording sheet and the intermediate transfer belt at the secondary transfer nip, thereby charging the toner of the toner image so as to have a charge with the opposite polarity, resulting in occurrence of defective transferring (i.e., formation of a low density image).

In attempting to solve the problem, a technique such that a proper amount of transfer current is determined based on the ratio of the area of a first toner image to the area of the overlapped portion of the first toner image and a second toner image, and the thus determined proper transfer current is applied to a transfer blade to satisfactorily transfer the combined toner image is proposed.

However, even when such a technique is used, a defective transfer problem such that a specific color portion of a combined toner image is not satisfactorily transferred is caused depending on the configuration of the combined toner image (such as area ratios of the color toner images constituting the combined toner image).

For these reasons, the present inventor recognized that there is a need for an image forming apparatus which can produce high quality multicolor images without causing the defective transfer problem even when the area ratios of multiple color toner images change.

BRIEF SUMMARY OF THE INVENTION

This patent specification describes a novel image forming apparatus, one embodiment of which includes one or more image bearing members to bear different color toner images; an endless intermediate transfer medium; a primary transfer device to transfer the primary color toner images on the one or more image bearing members to the intermediate transfer medium to form a combined color toner image on the intermediate transfer medium; a nip forming member contacted with the intermediate transfer medium to form a secondary transfer nip at which the combined color toner image is transferred to a recording sheet; and a secondary transfer current output device to apply a secondary transfer current to the secondary transfer nip to transfer the combined color toner image while determining the secondary transfer current based on image area ratios of the primary color toner images of the combined color toner image using a predetermined algorithm.

When determining the secondary transfer current, the secondary transfer current output device estimates the target value of a transfer current per unit area for each of the primary color toner images in such a manner that the target value of a transfer current per unit area needed for secondarily transferring one of the primary color toner images is not lower than that needed for secondarily transferring another of the primary color toner images, which is primarily transferred to the intermediate transfer medium next to the one of the primary color toner images, and the target value of a transfer current per unit area needed for secondarily transferring a first of the primary color toner images, which is primarily transferred firstly, is lower than that needed for secondarily transferring a last of the primary color toner images, which is primarily transferred lastly among the primary color toner images, and then determines the secondary transfer current based on the estimated target values of the transfer currents for all the primary color toner images.

This patent specification describes a novel method for transferring color toner images, one embodiment of which includes primarily transferring primary color toner images on one or more image bearing members to an intermediate transfer medium to form a combined color toner image thereon; secondarily transferring the combined color toner image to a recording sheet at a secondary transfer nip while applying a secondary transfer current to the secondary transfer nip; and determining the secondary transfer current based on image area ratios of the primary color toner images of the combined color toner image using a predetermined algorithm.

The secondary transfer current determining includes estimating the target value of a transfer current per unit area for each of the primary color toner images in such a manner that the target value of a transfer current per unit area needed for secondarily transferring one of the primary color toner images is not lower than that needed for secondarily transferring another of the primary color toner images, which is primarily transferred to the intermediate transfer medium next to the one of the primary color toner images, and the target value of a transfer current per unit area needed for secondarily transferring a first of the primary color toner images, which is primarily transferred firstly, is lower than that needed for secondarily transferring a last of the primary color toner images, which is primarily transferred lastly among the primary color toner images; and then determining the secondary transfer current based on the estimated target values of the transfer currents for all the primary color toner images.

BRIEF DESCRIPTION OF THE SEVERAL VIEWS OF THE DRAWINGS

A more complete appreciation of aspects of the invention and many of the attendant advantage thereof will be readily obtained as the same become better understood by reference to the following detailed description when considered in connection with the accompanying drawings, wherein.

DETAILED DESCRIPTION OF THE INVENTION

Figure 1:
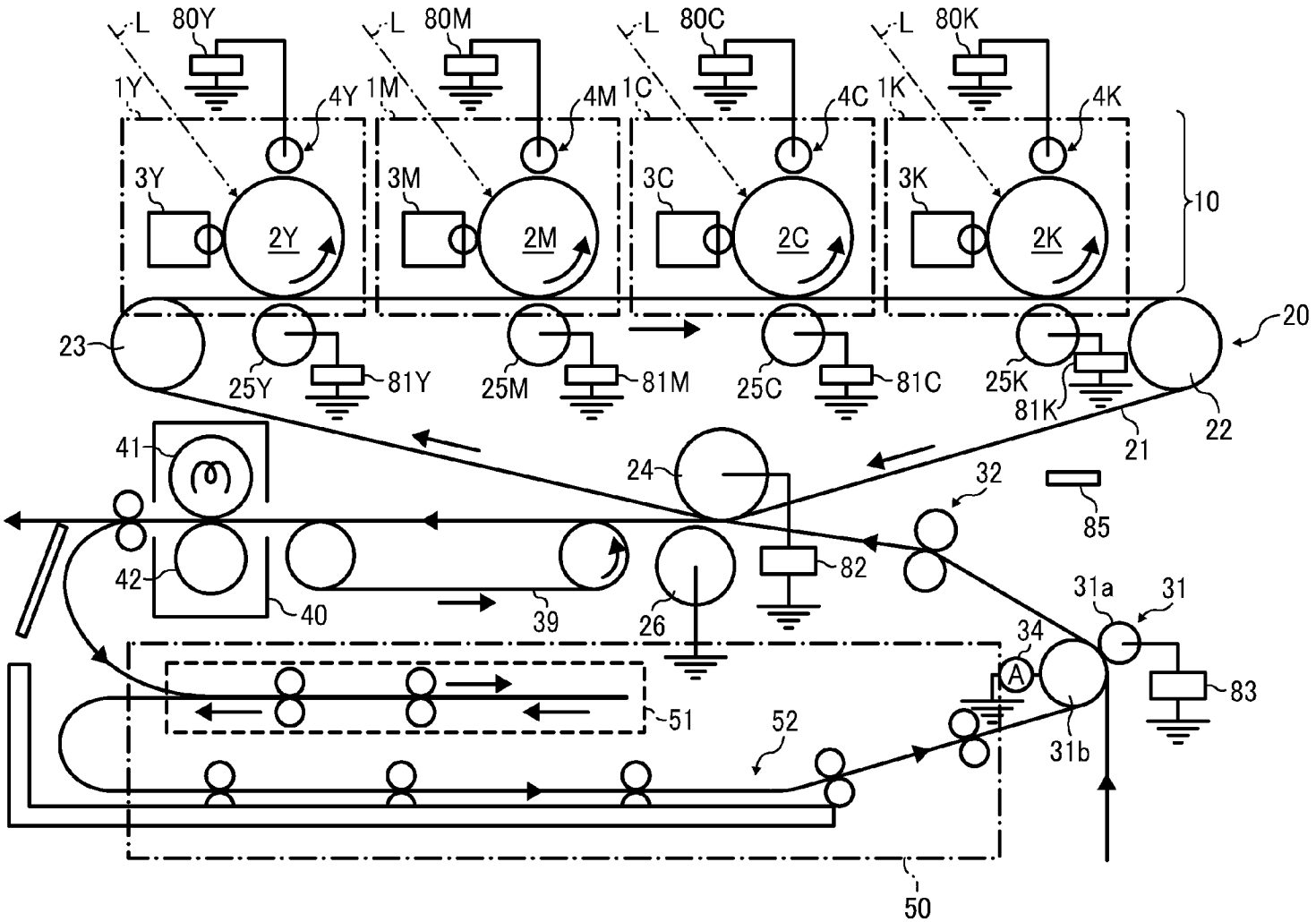
FIG. 1 is a schematic view illustrating a printer as one example of the image forming apparatus of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above""upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, example embodiments of the present patent application are described.

The present inventor has investigated the reason why the defective transfer problem such that a specific color portion of a combined toner image is not satisfactorily transferred is caused depending on the configuration of the combined toner image (such as area ratios of multiple color toner images) is caused. As a result, the present inventor discovers that the proper secondary transfer current for satisfactorily transferring a combined color toner image from an intermediate transfer belt onto a recording sheet changes depending on the quantity of charge of each of color toner images constituting the combined color toner image per a unit area as well as the area ratios of the color toner images. Specifically, as the quantity of charge of each of color toner images increases, the proper secondary transfer current for satisfactorily transferring the combined color toner image increases. In this regard, in general image forming apparatuses, electrostatic latent images formed on respective image bearing members are developed while controlling the charge quantities of toners per unit weight (i.e., Q/M) by controlling the developing conditions, and the toner concentrations of the developers contained in the developing devices. Therefore, the quantity of charge of each of color toner images per unit area falls in a predetermined range right after the color toner images are formed. Therefore, it has been considered that the proper secondary transfer current can be correctly determined based on the area ratios of multiple color toner images without taking the charge quantities of the toners into consideration. However, as a result of the present inventor's investigation, it is discovered that the charge quantities of Y, M, C and K toners per unit area are largely different right before the color toner images enter a secondary transfer nip.

The reason why the charge quantities of Y, M, C and K toners per unit area are different is considered as follows. As mentioned above, the charge quantity per unit area of each of color toner images falls in a predetermined range right after the color toner images are formed. However, since color toner images except for a last-transferred color toner image pass one or more primary transfer nips at which other toner images are transferred onto the intermediate transfer belt, the color toner images receive additional primary transfer currents at the primary transfer nips, thereby increasing the charge quantities of the toners of the color toner images. Since the number of times that the Y, M, C and K toners receive additional primary transfer currents is different, the charge quantities per unit area of the Y, M, C and K toners are largely different right before the color toner images (i.e., the combined color toner image) enter the secondary transfer nip. Therefore, even when the area of the combined color toner image is constant, the charge quantity of the combined color toner image changes when the area ratios of the color toner images are different. Therefore, when the secondary transfer current is determined based on the area of the combined color toner image without taking the area ratios of the color toner images into consideration, a problem in that the applied secondary transfer current is largely different from the proper secondary transfer current is caused in some cases depending on the area ratios of the color toner images, thereby causing the defective transfer problem.

Next, the image forming apparatus of the present invention will be described by reference to a tandem color printer.

Initially, the structure of the color printer will be described. FIG. 1 is a schematic view illustrating the color printer. The color printer includes an optical writing unit (not shown in FIG. 1), a tandem image forming section 10, a transfer unit 20, a fixing device 40, and a reforwarding device 50. The tandem image forming section 10 includes four image forming units 1Y, 1M, 1C and 1K, which respectively form yellow (Y), magenta (M), cyan (C) and black (K) toner images.

The transfer unit 20 includes an endless intermediate transfer belt 21, a driving roller 22, a driven roller 23, a secondary transfer facing roller 24, four primary transfer rollers 25Y, 25M, 25C and 25K, and a secondary transfer roller 26. The endless intermediate transfer belt 21, which serves as an intermediate image bearing member, is tightly stretched across the driving roller 22, the driven roller 23, and the secondary transfer facing roller 24 so as to have an inverted triangle form when observed from the side. The intermediate transfer belt 21 is rotated clockwise by the driving roller 22. Photoreceptors 2Y, 2M, 2C and 2K, and the intermediate transfer belt 21 are rotated such that the surfaces thereof move at a process speed of 120 mm/s.

The driving roller 22, the driven roller 23, the secondary transfer facing roller 24, and the four primary transfer rollers 25 are provided inside the loop of the intermediate transfer belt 21. The roles of the primary transfer rollers 25 and the secondary transfer roller 26 will be described later.

The tandem image forming section 10 has a structure such that the four image forming units 1Y, 1M, 1C and 1K are laterally aligned along the stretched upper surface of the intermediate transfer belt 21 so as to be located above the transfer unit 20. Each of the image transfer units 1 includes the drum-shaped photoreceptor 2, which is rotated counter-clockwise, a developing device 3 (3Y, 3M, 3C or 3K), and a charger 4 (4Y, 4M, 4C or 4K). In addition, each image forming unit 1 includes a drum cleaner (not shown) to clean the surface of the photoreceptor 2.

Each of the photoreceptors 2Y, 2M, 2C and 2K is contacted with the stretched upper surface of the intermediate transfer belt 21 to form primary transfer nips while rotated counter-clockwise by a driver (not shown). The developing devices 3Y, 3M, 3C and 3K respectively develop electrostatic latent images formed on the photoreceptors 2Y, 2M, 2C and 2K using Y, M, C and K toners. The chargers 4Y, 4M, 4C and 4K respectively charge the surfaces of the photoreceptors 2Y, 2M, 2C and 2K so that the surfaces of the photoreceptors have charges with the same polarity as that of charges of the toners. In this example, the photoreceptors 2 are charged such that the surfaces thereof have a potential of about −500V.

The primary transfer rollers 25Y, 25M, 25C and 25K, which are provided inside the loop of the intermediate transfer belt 21, press the intermediate transfer belt toward the photoreceptors 2Y, 2M, 2C and 2K. Primary transfer bias power sources 81Y, 81M, 81C and 81K apply a primary transfer bias to the corresponding primary transfer rollers 25Y, 25M, 25C and 25K. The primary transfer rollers 25 and the primary transfer bias power sources 81 serve as a primary transfer device.

The primary transfer rollers 25 has a metal core and an elastic layer formed on the surface of the metal core. The elastic layer is made of an electroconductive sponge prepared by foaming a resin in which an ionic electroconductive agent is dispersed, and has a volume resistivity of about $4\times10^{8}\Omega\cdot$cm under laboratory atmospheric conditions (25° C. and 40% RH, hereinafter referred to as normal conditions), and a volume resistivity of about $1\times10^{8}\Omega\cdot$cm under high temperature and high humidity atmospheric conditions (27° C. and 80% RH, hereinafter referred to as HH conditions).

In this regard, a resistivity meter HIRESTA UP Model MCP-HT450 from Mitsubishi Chemical Analytech Co., Ltd. is used, and the applied voltage is 100V.

The primary rollers 25 are set so as to be deviated from the rotation centers of the photoreceptors 2 by about 3 mm in the moving direction of the intermediate transfer belt 21.

The intermediate transfer belt 21 is made of a polyamide resin in which carbon black is dispersed, and has a thickness of 80 μm and an elasticity of greater than 3.5 GPa. In addition, the intermediate transfer belt 21 has a volume resistivity of about $3\times10^{11}\Omega\cdot$cm under the normal conditions, and a volume resistivity of about $2\times10^{9}\Omega\cdot$cm under the HH conditions.

In this regard, the resistivity meter HIRESTA UP Model MCP-HT450 is used, and the applied voltage is 100V.

An optical writing unit is provided above the tandem image forming section 10 although the optical writing unit is not illustrated in FIG. 1. The optical writing unit subjects the surfaces of the photoreceptors 2, which have been evenly charged by the chargers 4, to optical scanning using light beams L to form electrostatic latent images on the surfaces of the photoreceptors 2. In this regard, the potential of an irradiated portion of the surfaces of the photoreceptors 2, which is irradiated with the light beams L, is decreased from about −500V to about −300V. Namely, the background portion of an electrostatic latent image (i.e., non-irradiated portion) has a potential of about −500V, and the image portion (i.e., irradiated portion) has a potential of about −300V.

The electrostatic latent images thus formed on the photoreceptors 2Y, 2M, 2C and 2K are developed by the developing units 3Y, 3M, 3C and 3K, respectively, resulting in formation of Y, M, C and K toner images on the photoreceptors 2Y, 2M, 2C and 2K. In this regard, the development is performed in such a manner that when a solid toner image is formed on the photoreceptor 2 by developing an electrostatic latent image corresponding to the solid image, the weight of the solid toner image is about 0.45 mg/cm$^2$.

The Y, M, C and K toner images formed on the photoreceptors 2Y, 2M, 2C and 2K are contacted with the outer surface of the intermediate transfer belt 21 at the Y, M, C and K primary transfer nips so as to be transferred to the outer surface, resulting in formation of a combined toner image thereon, in which the Y, M, C and K toner images are overlaid.

In this printer, each of the chargers 4 includes a charging member, which is contacted with the surface of the corresponding photoreceptor 2 or is set close to the surface, and a power source for charging 80 (80Y, 80M, 80C or 80K) to apply a charge bias to the charging member to cause discharge between the charging member and the photoreceptor, thereby evenly charging the surface of the photoreceptor 2. Other chargers such as scorotron can also be used for the chargers 4.

The transfer unit 20 includes the secondary transfer roller 26, which is located below the intermediate transfer belt 21 and which serves as a nip forming member. The secondary transfer roller 26 is grounded and contacted with the outer surface of the intermediate transfer belt 21 at such a location as to be opposed to the secondary transfer facing roller 24 with the intermediate transfer belt therebetween. Since a secondary transfer bias power source 82 applies a secondary transfer bias having the same polarity as that of charges of the toners to the secondary transfer facing roller 24, a secondary transfer electric field such that the toner images on the intermediate transfer belt 21 are electrostatically moved toward the secondary transfer roller 26 is formed at the secondary transfer nip formed by the secondary transfer facing roller 24 and the secondary transfer roller 26.

The secondary transfer facing roller 24 has a diameter of 16 mm, and a volume resistivity of about $1\times10^4\Omega\cdot$cm. In contrast, the secondary transfer roller 26 includes a metal core having a diameter of 12 mm and an elastic layer formed on the surface of the metal core, and has a diameter of 24 mm. The elastic layer is made of an electroconductive sponge prepared by foaming a resin in which an ionic electroconductive agent is dispersed, and has a volume resistivity of about $5\times10^8\Omega\cdot$cm under the normal conditions, and a volume resistivity of about $2\times10^8\Omega\cdot$cm under the HH conditions.

In this regard, a resistivity meter HIRESTA UP Model MCP-HT450 from Mitsubishi Chemical Analytech Co., Ltd. is used, and the applied voltage is 100V.

The recording sheet is timely fed to the secondary transfer nip so that the combined color toner image on the intermediate transfer belt 21 is transferred to the proper portion of the recording sheet by means of the nip pressure and the secondary transfer electric field.

The recording sheet, to which the combined color toner image is transferred at the secondary transfer nip, is fed to the fixing device 40 by a sheet feeding belt 39, which is rotated counterclockwise, while attracted by the stretched upper surface of the sheet feeding belt. In the fixing device 40, the recording sheet is nipped at a fixing nip formed by a heat roller 41 including a heat source such as halogen heaters therein and a pressure roller 42 pressed to the heat roller, and thereby the combined color toner image is fixed to the recording sheet upon application of heat and pressure thereto. The recording sheet bearing the fixed toner image thereon is discharged from the printer by a pair of discharging rollers (not shown in FIG. 1) when no image is to be formed on the backside of the recording sheet (i.e., when a single print mode is elected).

When another image is formed on the backside of the recording sheet (i.e., when a double-sided print mode is elected), the recording sheet bearing a fixed toner image on one surface thereof is fed to the reforwarding device 50 by switching a switching pick (not shown).

The reforwarding device 50 allows the recording sheet bearing a fixed toner image on one surface thereof to switch back in a switchback passage 51 so that the recording sheet is inverted. The thus inverted recording sheet is fed to a passage 52 to feed the recording sheet to a point of a sheet feeding passage, which is used for feeding the recording sheet in a sheet cassette to the secondary transfer nip. In this regard, the point of the sheet feeding passage is located on an upstream side from a pair of resistivity measuring rollers 31 and a pair of registration rollers 32 relative to the sheet feeding direction (namely, each of the recording sheet fed from the sheet cassette and the recording sheet fed by the reforwarding device 50 passes through the pair of resistivity measuring rollers 31 and the pair of registration rollers 32). The pair of resistivity measuring rollers 31 has a voltage applying roller 31*a*, and a backup roller 31*b*. Numerals 83 and 34 denote a voltage applier and an ammeter. In addition, numeral 85 denotes a temperature and humidity sensor to detect the temperature and humidity of atmosphere of the printer.

After a second toner image is transferred onto the backside of the recording sheet at the secondary transfer nip, the recording sheet is fed to the fixing device 40 so that the second toner image is fixed thereto, thereby forming a duplex copy. The duplex copy is discharged from the printer by the pair of discharging rollers (not shown).

The pair of registration rollers 32 has such a function that when the recording sheet strikes the rollers, which are not rotated, skew of the recording sheet is corrected. Thereafter, the rollers are rotated to pinch the tip of the recording sheet, and then stopped rapidly. The pair of registration rollers 32 is timely rotated to feed the recording sheet to the secondary transfer nip so that the toner image on the intermediate transfer belt 21 is transferred onto a proper position of the recording sheet at the secondary transfer nip.

Figure 2:
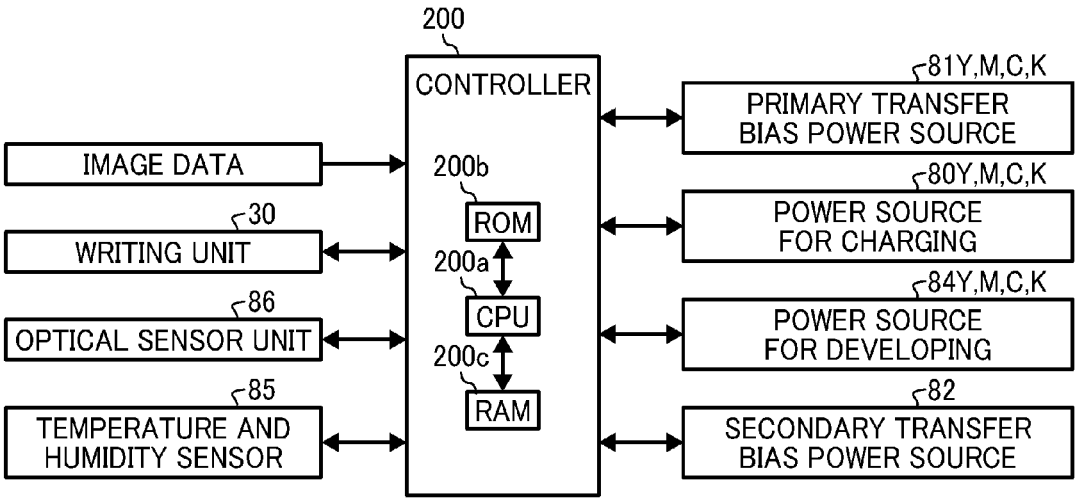
FIG. 2 is a block diagram illustrating part of the electric circuit of the printer illustrated in FIG. 1.

FIG. 2 is a block diagram illustrating part of the electric circuit of the printer illustrated in FIG. 1. Referring to FIG. 2, a controller 200 of the printer includes a central processing unit (CPU) 200*a* serving as a computing device, a random access memory (RAM) 200*c* serving as a non-volatile memory, and a read only memory (ROM) 200*b* serving as a temporary storage device. The controller 200 controls the entire of the printer, and is connected with various devices and sensors. Among the various devices and sensors, several devices and sensors are illustrated in FIG. 2. For example, a writing unit 30 to irradiate the charged photoreceptors 2 with light L to form electrostatic latent images thereon, an optical sensor unit 86 (described below), the temperature and humidity sensor 85, the primary transfer bias power sources 81, the power sources for charging 80, power sources for developing 84 to apply a bias to the corresponding developing devices 3, and the secondary transfer bias power source 82 are connected with the controller 200. In addition, image data are sent from an external device (such as personal computers) to the controller 200.

The controller 200 controls driving of the devices of the printer according to control programs stored in the RAM 200*c* and ROM 200*b*. In addition, according to image data (optical writing signals) sent from external devices such as personal computers, the controller 200 determines the Y, M, C and K primary transfer currents, and controls the primary transfer bias power sources 81Y, 81M, 81C and 81K so that the power sources output the determined primary transfer currents. Therefore, the controller 200 and the primary transfer bias power sources 81 serve as a primary transfer current output device. In this regard, the target values of the primary transfer currents to be output by the primary transfer bias power sources 81 are input as PWM signals to the primary transfer bias power sources by the controller 200.

Figure 3:
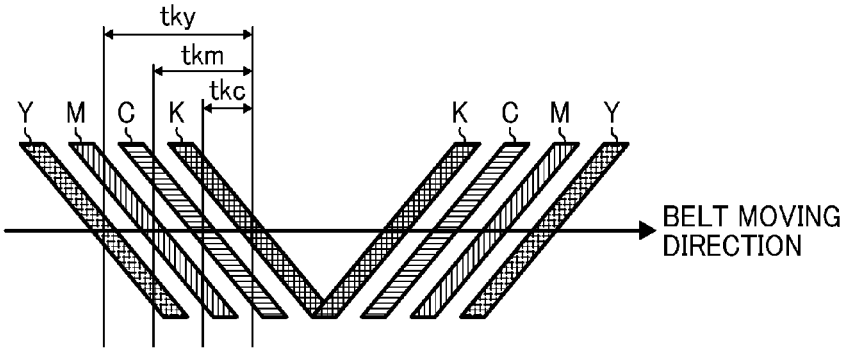
FIG. 3 is a schematic view illustrating a chevron patch.

The controller 200 performs a misregistration correction processing right after the main power switch is turned on or every time after a predetermined number of prints are produced. In the misregistration correction processing, a misregistration detection image called as a chevron patch PV, which is constituted of multiple toner images and which is illustrated in FIG. 3, is formed on the intermediate transfer belt 21. An optical sensor unit 86 (illustrated in FIG. 2) emits a light beam from a light source thereof to irradiate the surface of the intermediate transfer belt 21 after passing the light beam through a collecting lens thereof, and receives the reflected light using a photoreceiver thereof. The optical sensor unit 86 outputs a voltage corresponding to the amount of light received. In this regard, when the chevron patch PV formed on the intermediate transfer belt 21 passes under the optical sensor unit 86, the amount of light received by the photoreceiver of the optical sensor unit 86 largely changes. Therefore, the controller 200 can detect each of the toner images of the chevron patch PV formed on the intermediate transfer belt 21. Thus, the combination of the optical sensor unit 86 and the controller 200 serves as an image detecting device. In this regard, LEDs and the like capable of emitting light in an amount such that the toner images can be detected by the reflected light can be used as the light source of the optical sensor unit 86. In addition, CCDs and the like in which multiple light receiving elements are linearly arranged can be used as the photoreceiver of the optical sensor unit 86.

By detecting each of the toner images of the chevron patch PV formed on the intermediate transfer belt 21, the controller 200 can detect the position of each of the toner images in the sub-scanning direction (i.e., the belt moving direction). As illustrated in FIG. 3, the chevron patch PV includes Y, M, C and K toner line images, which are slanting at an angle of 45° relative to the main scanning direction (perpendicular to the sub-scanning direction) and which are formed at regular intervals in the belt moving direction. The controller 200 determines the time difference between the detection time of the K toner image and the detection time of each of the Y, C and M toner images. In the chevron patch PV illustrated in FIG. 3, first Y, M, C and K toner images are arranged from the left side, and second K, C, M and Y toner images which are slanting at an angle of 90° relative to the first Y, M, C and K toner images, are arranged from the left side. By determining time differences tky, tkc and tkm between the detection time of the K toner image and the detection time of each of the Y, C and M toner images, the amount of misregistration of each of the Y, C and M toner images in the sub-scanning direction can be determined. The controller 200 adjusts the timings of optical writing operations performed by the optical writing unit (not shown) based on the amounts of misregistration of the Y, C and M toner images. Thus, the amount of misregistration of toner images caused by change in velocity of the photoreceptors 2Y, 2M, 2C and 2K and the intermediate transfer belt 21 can be reduced.

Next, the feature of this printer will be described.

Figure 4:
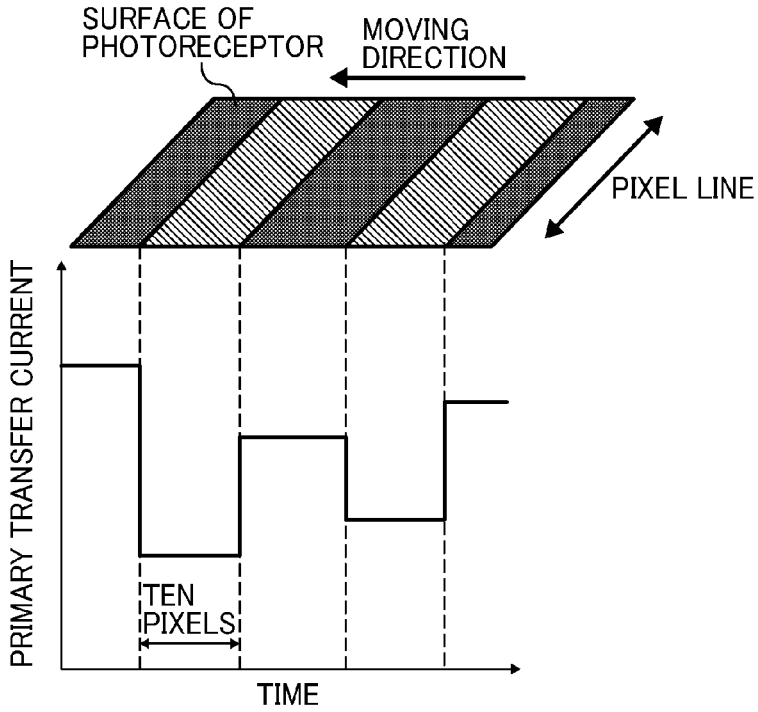
FIG. 4 is a schematic view for describing a ten-line area.

Each of the primary transfer bias power source 81, which applies a primary transfer bias to the corresponding primary transfer roller 25, performs constant current control such that a transfer current equal to the target current is output, or constant voltage control such that a transfer voltage equal to the target voltage is output. In this regard, the target value in the constant current control or the constant voltage control is determined based on the image area ratio in the main scanning direction of a toner image on the photoreceptor, which image is passing the exit of the primary transfer nip and the vicinity of the exit. Specifically, as illustrated in FIG. 4, the surface of the photoreceptor 2 is theoretically separated in the sub-scanning direction (i.e., the photoreceptor moving direction) into multiple areas, each of which has a length corresponding to ten pixels, starting from the top of a page (image). Namely, each of the multiple areas (hereinafter referred to as a ten-line area) includes 10 pixel lines, in each of which pixels align in the main scanning direction. In this regard, the image area ratio is defined as a ratio of the number of pixels of the image in a pixel line to the total number of pixels in the pixel line. The average image area ratio of the image in the ten-line area is determined by averaging the image area ratios of the ten pixel lines included in the ten-line area. The target value of the primary transfer current or voltage is determined based on the average image area ratio of one of the multiple ten-line areas, which is passing the exit of the primary transfer nip, and the primary transfer bias power source 81 adjusts the output so as to be equal to the target value when the ten-line area passes the primary transfer nip. When the last pixel line of a ten-line area has passed the exit of the primary transfer nip, the target value of the output from the primary transfer bias power source 81 is changed so as to be based on the average image area ratio of the next ten-line area.

The reason why the target value of the primary transfer current or voltage is determined based on the average image area ratio of an image in a ten-line area, which is passing the vicinity of the exit of the primary transfer nip, is as follows. Specifically, most of the current flowing between the photoreceptor 2 and the intermediate transfer belt 21 is the current caused by aerial discharge between the photoreceptor and the intermediate transfer belt at the exit of the primary transfer nip. In a case where the current supplied from the primary transfer bias power source is relatively low and the image area ratio is relatively low, most of the current supplied from the primary transfer bias power source is used for aerial discharge between the photoreceptor and the intermediate transfer belt at the exit of the primary transfer nip, and current is hardly flown through the toner image on the photoreceptor, thereby causing the defective transfer problem in that the toner image is not satisfactorily transferred onto the intermediate transfer belt. By flowing a transfer current corresponding to the average image area ratio of the toner image passing the vicinity of the exit of the primary transfer nip, it becomes possible to flow a proper current through the toner image while reducing the potential difference between the photoreceptor and the intermediate transfer belt so as to be lower than the discharge starting voltage.

The secondary transfer bias power source 82, which applies a secondary transfer bias to the secondary transfer facing roller 24, performs constant current control such that a secondary transfer current equal to the target current is applied. The target current is determined based on the image area ratio in the main scanning direction of a toner image on the intermediate transfer belt, which image is passing the vicinity of the exit of the secondary transfer nip. Specifically, similarly to the surface of the photoreceptor, the surface of the intermediate transfer belt 21 is theoretically separated in the sub-scanning direction into multiple areas, each of which has a length corresponding to ten pixels, starting from the top of a page (image). Each of the multiple areas (hereinafter referred to as a ten-line area) includes 10 pixel lines, in each of which pixels align in the main scanning direction. In this regard, the image area ratio is defined as a ratio of the number of pixels of the image in a pixel line to the total number of pixels in the pixel line. The average image area ratio of the image in the ten-line area is determined by averaging the image area ratios of the pixel lines included in the ten-line area. The target value of the second transfer current is determined based on the average image area ratio of one of the multiple ten-line areas, which is passing the exit of the secondary transfer nip, and the secondary transfer bias power source 82 adjusts the output current so as to be equal to the target current when the ten-line area passes the secondary transfer nip. When the last pixel line of a ten-line area has passed the exit of the secondary transfer nip, the target value of the current output from the secondary transfer bias power source 82 is changed so as to be based on the average image area ratio of the next ten-line area.

Figure 5:
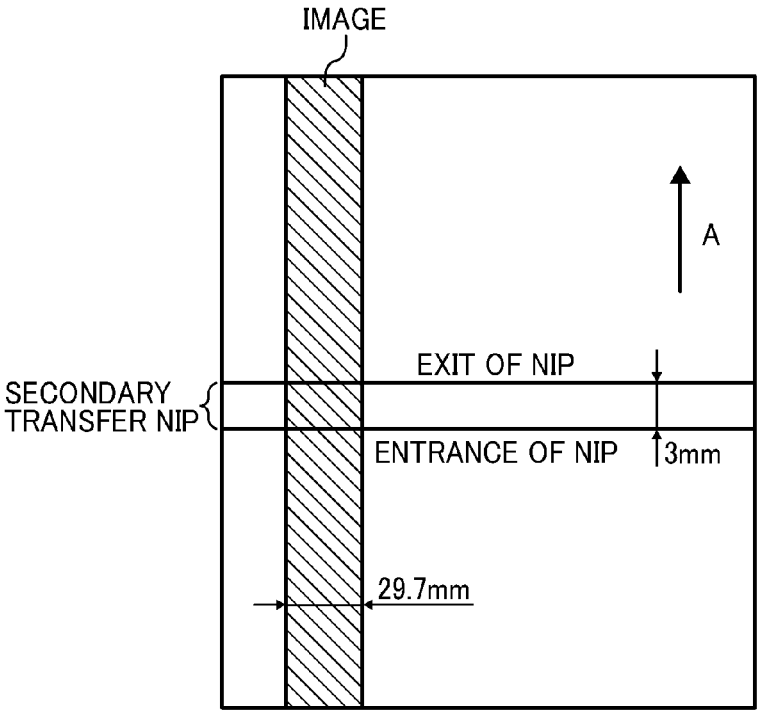
FIG. 5 is a schematic view illustrating an image formed on a recording sheet.

FIG. 5 is a schematic view illustrating an image formed on a recording sheet. The recording sheet is an A-3 size plain paper sheet, and is fed in a direction A in the printer. At the primary transfer nip, the direction A is the same as the sub-scanning direction. A strip-shaped image, which extends in the sub-scanning direction and which has a length of 29.7 mm in the main scanning direction, is formed on the recording sheet. In this regard, the length of the recording sheet in the main scanning direction is 297 mm as described in FIG. 5. Since the image extends in the sub-scanning direction from the top to the end of the recording sheet, the image area ratio is constant (10%) at any position of the recording sheet in the sub-scanning direction. Namely, when such an image is output, the average image area ratio of the ten-line area passing the exit of the primary transfer nip is always 10%. Therefore, unlike the primary transfer current illustrated in FIG. 4, a constant primary transfer current continues to be applied to the primary transfer roller.

Figure 6:
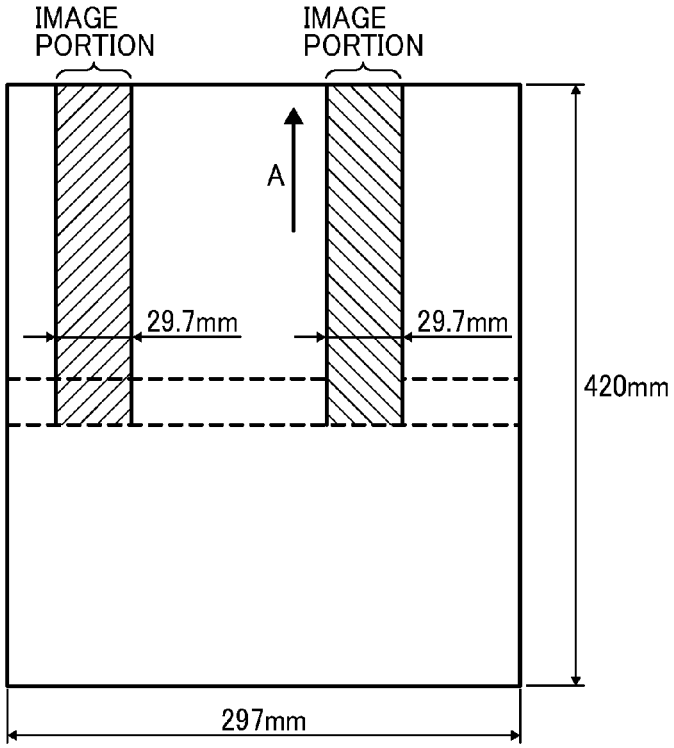
FIG. 6 is a schematic view illustrating another image formed on a recording sheet.

FIG. 6 is a schematic view illustrating another image, which is being transferred from the intermediate transfer belt to a recording sheet. Two strip-shaped images, each of which extends in the sub-scanning direction and has a length of 29.7 mm in the main scanning direction and a length of 420 mm in the sub-scanning direction, are formed on the recording sheet. Since the two strip-shaped images extend from the top to the end of the recording sheet, the image area ratio is constant (20%) at any position of the recording sheet in the sub-scanning direction. In FIG. 6, the entrance and exit of the secondary transfer nip are illustrated by two dotted lines, and the latter half portions of the images are not illustrated.

Figure 7:
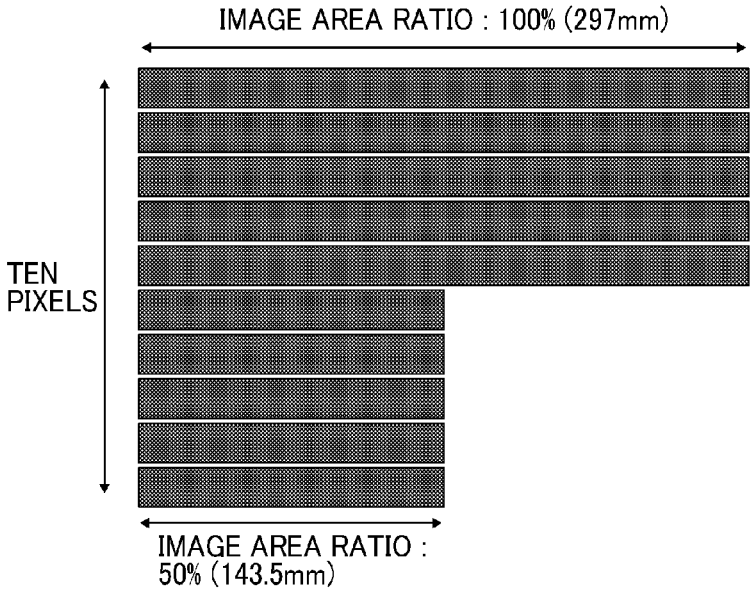
FIG. 7 is a schematic view illustrating yet another image formed on a recording sheet.

FIG. 7 is a schematic view illustrating a ten-line area of another image formed on a recording sheet. The length of the image in the main scanning direction is not constant at positions of the recording sheet in the sub-scanning direction. In the ten-line area illustrated in FIG. 7, the first to fifth pixel lines of the ten-line area have an image area ratio of A % (100% in FIG. 7), and the sixth to tenth pixel lines have an image area ratio of B % (50% in FIG. 7). The average image area ratio of the ten-line area is (A×5+B×5)/10% (75% in FIG. 7).

In a case where the Y, M, C and K toners in the developing units 3Y, 3M, 3C and 3K have the same charge quantity per unit weight, and the Y, M, C and K toner images formed on the photoreceptors 2Y, 2M, 2C and 2K are independently transferred onto the intermediate transfer belt 21, the charge quantities of the toner images per unit area are the same as each other just after the toner images are primarily transferred. However, when the Y, M, C and K toner images are moved to a point just before the secondary transfer nip, the charge quantities of the toner images per unit area are different from each other. This is because the number of times that the Y, M, C and K toner images pass primary transfer nips is different. Specifically, when a toner image passes a primary transfer nip, the toner image is influenced by the primary transfer current applied to the primary transfer nip, and the charge quantity of the toner is increased so as to be slightly higher than that of the toner image (hereinafter referred to as charge-up) just after the toner image is formed on the photoreceptor by the developing device. Among Y, M, C and K toner images, the K toner image, which is last transferred, passes only one primary transfer nip, and therefore the K toner image causes the charge-up once. In contrast, since the C toner image passes the C and K primary transfer nips, the C toner image causes the charge-up twice. Since the M toner image passes the M, C and K primary transfer nips, the M toner image causes the charge-up three times. Since the Y toner image passes the Y, M, C and K primary transfer nips, the Y toner image causes the charge-up four times. Thus, the number of times of the charge-up is different, the charge quantities of the Y, M, C and K toner images just before the toner images enter the secondary transfer nip are different.

In general, the charge quantities QY, QM, QC and QK of the Y, M, C and K toner images per unit area just before the toner images enter the secondary transfer nip have the following relation:

$$|QY| \geq |QM| \geq |QC| \geq |QK|.$$

In a case where the primary transfer rollers 25 are set such that the centers of the rollers 25 are located on slightly downstream sides from the centers of the corresponding photoreceptors 2, the relation is strengthened, because the current caused by discharge at the exit of a primary transfer nip increases.

Figure 8:
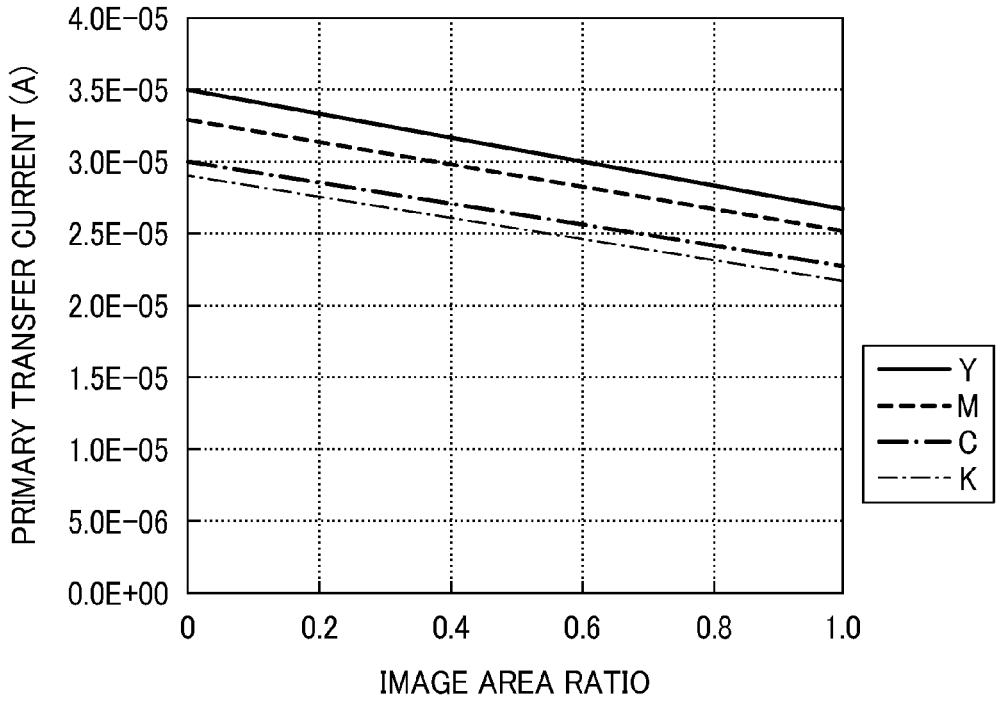
FIG. 8 is a graph showing an example of relation between image area ratio and primary transfer current, which is used for determining the primary transfer current.

In this printer, in order to prevent occurrence of a reverse translation problem in that a toner image, which is previously transferred onto the intermediate transfer belt 21, is reversely transferred onto a photoreceptor at a primary transfer nip, the primary transfer bias power sources 81Y, 81M, 81C and 81K determine the target values of the primary transfer currents for the Y, M, C and K toner images using such an algorithm as illustrated in FIG. 8. Specifically, as the portion of the primary transfer nip approaches the extreme downstream side relative to the belt moving direction, the target value of the primary transfer current for the primary transfer nip is set so as to be lower. Therefore, the above-mentioned relation is further strengthened.

The present inventor provided a test printer having a structure similar to that of this printer. Yellow, magenta, cyan and black toner images, which are independent from each other, were output on a A-3 size paper sheet, MY PAPER from Ricoh Business Expert, Ltd. using the test printer. In this regard, the secondary transfer bias power source 82 was controlled such that the target value of the secondary transfer current is calculated using the equations described in each of experiments 1-4 illustrated in Table 1. In each of the experiments 1-4, proper current values of the secondary transfer currents for Y, M, C and K toner images were calculated by multiplying the average image area ratios thereof ($\eta y$, $\eta m$, $\eta c$ and $\eta k$) by the same coefficient, and the target value of the secondary transfer current was determined as the total of the proper current values.

For example, when a Y toner image having an average image area ratio $\eta y$ of 5%, a M toner image having an average image area ratio $\eta m$ of 10%, a C toner image having an average image area ratio $\eta c$ of 15%, and a K toner image having an average image area ratio $\eta k$ of 20% are formed in the experiment 1, the target value of the secondary transfer current is −20.25 μA (=−15−10.5×(0.05+0.1+0.15+0.2)). In this regard, only the second terms (−10.5$\eta y$, −10.5$\eta m$, −10.5$\eta c$ and −10.5$\eta k$) are totaled, and the first term (−15) is not totaled.

TABLE 1

| No. of experiment | Color of toner image | Target value of secondary transfer current | Quality of image produced |
|---|---|---|---|
| 1 | Y | −15 + (−10.5 × ηy) | The image densities of the cyan and black toner images were low. |
| | M | −15 + (−10.5 × ηm) | |
| | C | −15 + (−10.5 × ηc) | |
| | K | −15 + (−10.5 × ηk) | |
| 2 | Y | −9.4 + (−10.5 × ηy) | The image density of the cyan toner image was slightly low, and the image density of the black toner image was low |
| | M | −9.4 + (−10.5 × ηm) | |
| | C | −9.4 + (−10.5 × ηc) | |
| | K | −9.4 + (−10.5 × ηk) | |
| 3 | Y | −7.4 + (−10.5 × ηy) | The image densities of the yellow, magenta and cyan toner images were slightly low. |
| | M | −7.4 + (−10.5 × ηm) | |
| | C | −7.4 + (−10.5 × ηc) | |
| | K | −7.4 + (−10.5 × ηk) | |
| 4 | Y | −4.2 + (−10.5 × ηy) | The image densities of the yellow, magenta and cyan toner images were low. |
| | M | −4.2 + (−10.5 × ηm) | |
| | C | −4.2 + (−10.5 × ηc) | |
| | K | −4.2 + (−10.5 × ηk) | |

As described in Table 1, the image densities of the cyan and black toner images were low in the experiments 1 and 2, and the image densities of the yellow, magenta and cyan toner images were low in the experiments 3 and 4. The reason therefor is considered to be that the charge quantities of the Y, M, C and K toner images are different from each other as illustrated in FIG. 2 below (the charge quantity was measured using Q/m TEST SYSTEM model 201HS from Trek, Inc.), and therefore the secondary transfer current is deviated from the proper value.

TABLE 2

| Toner image | Charge quantity of toner image just before the toner image enters second transfer nip (μC/g) |
|---|---|
| Y | −42 |
| M | −39 |
| C | −34 |
| K | −24 |

Next, the secondary transfer bias power source 82 was controlled such that the target values of the secondary transfer currents for the Y, M, C and K toner images are calculated using an algorithm using coefficients corresponding to the charge quantities of the Y, M, C and K toner images just before the secondary transfer nip, and a print test was performed. The secondary transfer currents for the Y, M, C and K toner images were calculated using the equations illustrated in Table 3 below.

TABLE 3

| Toner image | Target value of secondary transfer current (μA) |
|---|---|
| Y | −15 + (−10.5 × ηy) |
| M | −15 + (−9.4 × ηm) |
| C | −15 + (−7.4 × ηc) |
| K | −15 + (−4.2 × ηk) |

As a result, the Y, M, C and K toner images transferred onto a A-3 size paper sheet, MY PAPER from Ricoh Business Expert, Ltd., had good image densities.

In this printer, the secondary transfer bias power source 82 estimates the transfer currents (−15+(−coefficient×η) necessary for transferring toner images formed on any two adjacent photoreceptors (such as Y and M toner images, M and C toner images, and C and K toner images) as follows. Specifically, a first transfer current necessary for transferring a first toner image, which is primarily transferred in first, is estimated to be not less than a second transfer current for transferring a second toner image, which is primarily transferred next. By using this method, the target value of the secondary transfer current is determined as the total of the transfer currents for all the toner images. By using this method, the target value can be determined so as to be nearer to a proper value than in a case of using conventional methods in which the secondary transfer current is determined without considering the order of primary transferring of the toner images. By using this method, occurrence of the defective transfer problem caused by change of image area ratio can be prevented.

Depending on the conditions of determining the target values of the primary transfer currents of Y, M, C and K toner images, there are cases such that the charge quantities of two toner images, which are sequentially primarily transferred, are hardly different; and the absolute charge quantity of a K toner image is much smaller than those of Y, M and C toner images. In such cases, for example, the target values of the secondary transfer currents for the Y, M, C and K toner images are determined as illustrated in Tables 4-6.

TABLE 4

| Toner image | Target value of secondary transfer current (μA) |
|---|---|
| Y | −15 + (−10.0 × ηy) |
| M | −15 + (−10.0 × ηm) |
| C | −15 + (−7.4 × ηc) |
| K | −15 + (−4.2 × ηk) |

TABLE 5

| Toner image | Target value of secondary transfer current (μA) |
|---|---|
| Y | −15 + (−10.0 × ηy) |
| M | −15 + (−10.0 × ηm) |
| C | −15 + (−5.5 × ηc) |
| K | −15 + (−5.5 × ηk) |

TABLE 6

| Toner image | Target value of secondary transfer current (μA) |
|---|---|
| Y | −15 + (−10.0 × ηy) |
| M | −15 + (−10.0 × ηm) |
| C | −15 + (−10.0 × ηc) |
| K | −15 + (−4.2 × ηk) |

Since it is impossible that the charge quantity per unit area of a K toner image just before the secondary transfer nip is larger than that of a Y toner image. Therefore, if the Y and K toner images have the same average image area ratio, it is preferable to determine the proper value (absolute value) of the secondary transfer current for the Y toner image so as to be larger than that for the K toner image.

Next, other examples of the image forming apparatus (printer), which have other features in addition to the feature of the above-mentioned printer, will be described.

EXAMPLE 1

As mentioned above, by determining the proper values of the secondary transfer currents for transferring four color toner images based on the image area ratios thereof, the proper values can be determined considerably precisely. In this regard, it is more preferable to determine the proper values in consideration of the overlapped image area. This is because the condition of discharge at an overlapped image area at the primary transfer nip is different from that at a non-overlapped image area.

As a result of the present inventor's experiments, the charge quantities of color toner images just before the secondary transfer nip were as follows.

TABLE 7

| Toner image | Charge quantity of first toner layer (arb. unit) | Charge quantity of second toner layer (arb. unit) | Charge quantity of third toner layer (arb. unit) | Charge quantity of fourth toner layer (arb. unit) | Total charge quantities (arb. unit) | Target value of secondary transfer current (μA) |
|---|---|---|---|---|---|---|
| Y | −42 (Y) | — | — | — | −42 | $-15+(-10.5\times\eta y)$ |
| M | −39 (M) | — | — | — | −39 | $-15+(-9.4\times\eta m)$ |
| C | −34 (C) | — | — | — | −34 | $-15+(-7.4\times\eta c)$ |
| K | −24 (K) | — | — | — | −24 | $-15+(-4.2\times\eta k)$ |
| R | −30 (Y) | −39 (M) | — | — | −69 | $-15+(-20.0\times\eta r)$ |
| G | −35 (Y) | −34 (C) | — | — | −69 | $-15+(-20.0\times\eta g)$ |
| B | −27 (M) | −34 (C) | — | — | −61 | $-15+(-17.2\times\eta b)$ |
| 3C | −30 (Y) | −27 (M) | −34 (C) | — | −91 | $-15+(-27.7\times\eta 3c)$ |
| 4C | −30 (Y) | −27 (M) | −24 (C) | −24 (K) | −105 | $-15+(-32.6\times\eta 4c)$ |

Therefore, in the printer of Example 1, the secondary transfer bias power source 82 performs the below-mentioned processing only for primary color toner images (i.e., non-overlapped Y, M, C and K toner images). Specifically, a first transfer current necessary for transferring a first toner image (such as Y, M and C toner images), which is primarily transferred in first, is estimated to be not less than a second transfer current for transferring a second toner image (such as M, C and K toner images), which is primarily transferred next. More specifically, the secondary transfer current necessary for secondarily transferring a Y toner image ($-\alpha+(\beta_y\times\eta y)$) is estimated to be not less than the secondary transfer current necessary for secondarily transferring a M toner image ($-\alpha+(\beta_m\times\eta m)$). In addition, the secondary transfer current necessary for secondarily transferring a M toner image ($-\alpha+(\beta_m\times\eta m)$) is estimated to be not less than the secondary transfer current necessary for secondarily transferring a C toner image ($-\alpha+(\beta_c\times\eta c)$). Further, the secondary transfer current necessary for secondarily transferring a C toner image ($-\alpha+(\beta_c\times\eta c)$) is estimated to be not less than the secondary transfer current necessary for secondarily transferring a K toner image ($-\alpha+(\beta_k\times\eta k)$).

In the printer of Example 1, the secondary transfer bias power source 82 performs an estimation processing such that the secondary transfer current necessary for transferring secondary, tertiary and quaternary color toner images (such as R, G, B, 3C and 4C toner images in FIG. 7) is determined based on the combinations of the primary color toner images constituting the secondary, tertiary and quaternary color toner images. By using this method, the proper values of the secondary transfer currents for transferring secondary, tertiary and quaternary color toner images can be determined more precisely, thereby making it possible to prevent occurrence of the defective transfer problem more securely.

A print test was performed using the test printer in which the secondary transfer bias power source 82 determines the target value of the secondary transfer current using the equations illustrated in Table 7. As a result, the image densities of primary, secondary, tertiary and quaternary color images were more uniform than in a case where the secondary transfer bias power source 82 determines the target value of the secondary transfer current using the equations illustrated in Table 3.

Each of the primary transfer bias power sources 81Y, 81M, 81C and 81K performs constant current control such that as the average image area ratio in a ten-line area of the photoreceptor increases, the target value (absolute value) of the primary transfer current is decreased. By performing this control, the charge quantities of the Y, M, C and K toner images per unit area after the primary transfer operation can be equalized.

EXAMPLE 2

The main difference between the printer of Example 2 and the printer of Example 1 mentioned above is as follows.

Specifically, each of the primary transfer bias power sources 81Y, 81M, 81C and 81K performs constant voltage control for the primary transfer bias such that the average image area ratio of a toner image in a ten-line area of the photoreceptor increases, the target value (absolute value) of the primary transfer voltage for the toner image is decreased. By performing this control, the charge quantities of the Y, M, C and K toner images per unit area after the primary transfer operation can be equalized.

In addition, the primary transfer bias power source 81 estimates the target value (absolute value) of a first transfer voltage necessary for transferring a first toner image, which is to be primarily transferred in first, to be not less than a second transfer voltage for transferring a second toner image, which is to be primarily transferred next. By using this method, occurrence of the reverse translation problem in that a toner image, which is previously transferred onto the intermediate transfer belt 21, is reversely transferred onto a photoreceptor at a primary transfer nip on a downstream side in the belt moving direction can be prevented.

Next, another example of the printer, which has a distinct structure in addition to the structures of the printers of Examples 1 and 2, will be described.

When images having a low average image area ratio are continuously produced, the Y, M, C and K developers in the developing devices 3Y, 3M, 3C and 3K are forcibly agitated even though the amounts of the consumed Y, M, C and K toners are small. In this case, the charge quantities per unit weight of the Y, M, C and K toners excessively increase, and it becomes difficult to precisely determine the proper value of the secondary transfer current. Therefore, in this printer, when images having average area ratios less than a predetermined threshold value are continuously produced, Y, M, C and K solid toner images are formed on non-image areas of the Y, M, C and K photoreceptors 2 (i.e., areas between two adjacent image areas) to forcibly consume the Y, M, C and K toners. By using this method, the charge quantities of the Y, M, C and K toners can be maintained so as to fall in the respective predetermined charge quantity ranges, and thereby the proper value of the secondary transfer current can be precisely determined.

Figure 9:
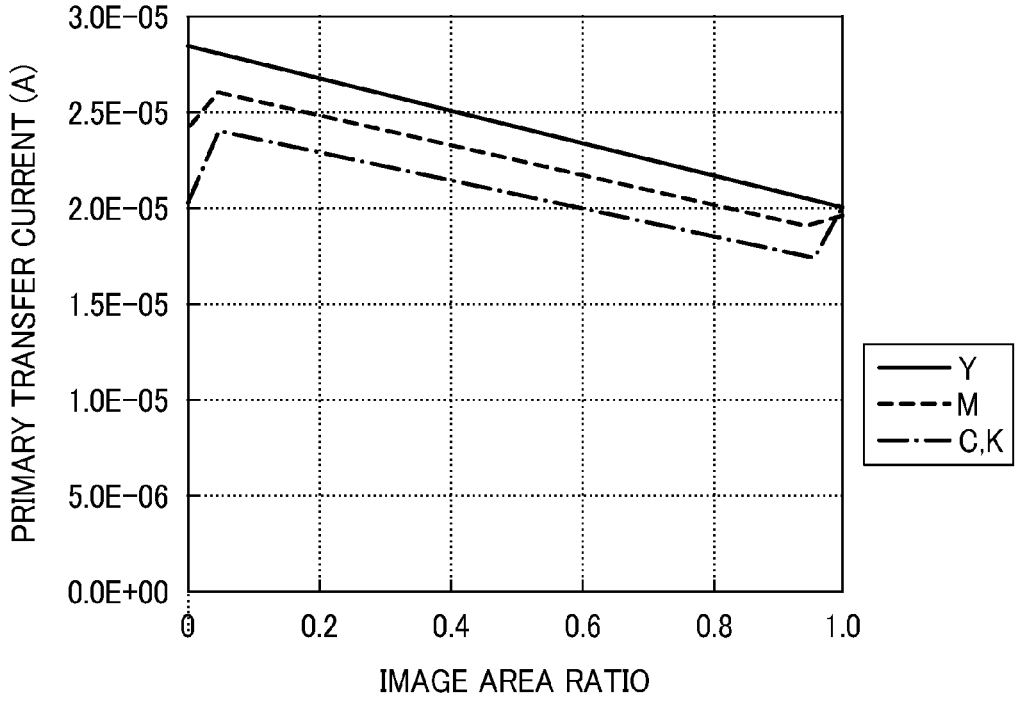
FIG. 9 is a graph showing another example of relation between image area ratio and primary transfer current, which is used for determining the primary transfer current.

Hereinbefore, the printer in which the average image area ratio in a ten-line area is determined and the target value of the secondary transfer current is changed depending on the average image area ratio has been described. However, the method of determining the average image area ratio, and the timing of change of the target value are not limited to the method and the timing mentioned above. For example, an average image area ratio method in which the average image area ratio in an area having a predetermined number of pixels (such as 1 or 100 pixels) is determined can also be used. In addition, a target value changing method in which the target value is gradually changed at the boundary between two adjacent ten-line areas can be used instead of the above-mentioned method in which the target value is rapidly changed at the boundary between two adjacent ten-line areas. Further, the algorithms for determining the target values of the primary transfer currents and the secondary transfer current are not limited to the algorithms mentioned above. Any algorithms for determining the target values based on the average image area ratios can be used. For example, an algorithm which is illustrated in FIG. 9 and which has an inflection point or a singularity can also be used.

In addition, hereinbefore the tandem color printer producing multiple color images using four color toners has been described. However, the image forming apparatus of the present invention is not limited thereto. For example, an image forming apparatus in which multiple developing devices are arranged around one photoreceptor to develop electrostatic latent images, which are formed one by one on the photoreceptor, with different color toners, and the resultant color toner images are transferred onto an intermediate transfer medium in every rotation cycle of the intermediate transfer medium to form a combined color toner image on the intermediate transfer medium can also be included in the image forming apparatus of the present invention.

The above-mentioned printers are examples of the image forming apparatus of the present invention. The present invention includes the following embodiments.

Embodiment A

The embodiment A of the image forming apparatus includes one or more image bearing members (e.g., the photoreceptors 2) to bear different primary color toner images; an intermediate transfer medium (e.g., the intermediate transfer belt 21) to which the primary color toner images on the one or more image bearing members are primarily transferred to form a combined color toner image thereon; a nip forming member (e.g., the secondary transfer roller 26) contacted with the intermediate transfer medium to form a transfer nip at which the combined color toner image on the intermediate transfer medium is secondarily transferred to a recording sheet; and a transfer current output device (e.g., the secondary transfer bias power source 82) to apply a secondary transfer current to the secondary transfer nip while determining the secondary transfer current based on the area ratios of the different color toner images using a predetermined algorithm.

The method for primarily transferring color toner images includes a method in which primary color toner images on multiple image bearing members are transferred onto the intermediate transfer medium in such a manner that the primary color toner images are sequentially transferred onto the intermediate transfer medium in the predetermined order at respective primary transfer nips, or a method in which each of the color toner images formed one by one on one image bearing member is transferred onto the intermediate transfer medium at one primary transfer nip in every rotation cycle of the intermediate transfer medium. The method for primarily transferring color toner images is not limited thereto.

The transfer current output device is characterized by determining the transfer current for transferring the combined color toner image to the recording sheet while estimating the transfer current per unit area needed for secondarily transferring one of the color toner images constituting the combined color toner image at the secondary transfer nip to be lower than that for secondarily transferring another of the color toner images, which is primarily transferred to the intermediate transfer medium after the one of the color toner images is primarily transferred thereto.

Embodiment B

The embodiment B is different from the embodiment A in that the transfer current output device is characterized by estimating the transfer current needed for secondarily transferring one of the color toner images constituting the combined color toner image to be not lower than that for secondarily transferring another of the color toner images, which is primarily transferred to the intermediate transfer medium next to the one of the color toner images. When the transfer current output device performs such estimation, the transfer currents needed for secondarily transferring the color toner images of the combined color toner image can be estimated in consideration of increase in charge quantity of the primary toner images, which changes depending on the number of times that the color toner images pass primary transfer nips.

Embodiment C

The embodiment C is different from the embodiment B in that the transfer current output device is characterized by estimating the transfer current needed for secondarily transferring a non-overlapped area of one of the color toner images, which area is not overlapped with the others of the color toner images, to be not lower than that for transferring a non-overlapped area of another of the color toner images, which image is primarily transferred to the intermediate transfer medium next to the one of the color toner images. When the transfer current output device performs such estimation, increase in charge quantity of the non-overlapped areas of the color toner images can be estimated independently of increase in charge quantity of the overlapped areas of the color toner images, thereby making it possible to determine the target value of the secondary transfer current so as to be close to the proper value.

Embodiment D

The embodiment D is different from the embodiment C in that the transfer current output device is characterized by estimating the transfer current needed for transferring an overlapped area of two or more of the primary color toner images based on the combination of the two or more of the primary color toner images. When the transfer current output device performs such estimation, the transfer current needed for secondarily transferring the overlapped area of two or more of the primary color toner images can be properly estimated, thereby making it possible to precisely estimate the transfer currents needed for secondarily transferring overlapped color toner images of two or more of the primary color toner images (e.g., secondary, tertiary and quaternary color toner images).

Embodiment E

The feature of the embodiment E is as follows. Specifically, in any one of the embodiments A-D, the transfer current output device is characterized by estimating the transfer currents needed for secondarily transferring the color toner images in such a manner that as the image area ratio of a color toner image increases, the absolute value of the target value of the secondary transfer current for secondarily transferring the color toner image is estimated so as to be greater. When the transfer current output device performs such estimation, lack of the transfer current can be avoided.

Embodiment F

The feature of the embodiment F is as follows. Specifically, in any one of the embodiments A-E, the primary color toner images on the multiple image bearing members are primarily transferred onto the intermediate transfer medium at respective primary transfer nips to form a combined color toner image on the intermediate transfer medium, and the image forming apparatus further includes a primary transfer current output device (e.g., the primary transfer bias power sources 81) which applies a primary transfer current individually to each of the primary transfer nips in such a manner that as the image area ratio of a primary toner image increases, the target value (absolute value) of the primary transfer current is decreased. When the image forming apparatus has such a configuration, the primary color toner images can be properly transferred onto the intermediate transfer medium without causing the deficient primary transfer problem.

Embodiment G

The feature of the embodiment G is as follows. Specifically, in any one of the embodiments A-E, the primary color toner images on the multiple image bearing members are primarily transferred onto the intermediate transfer medium at respective primary transfer nips to form a combined color toner image on the intermediate transfer medium, and the image forming apparatus further includes a primary transfer current output device (e.g., the primary transfer bias power sources 81) which applies a primary transfer current individually while performing constant voltage control to each of the primary transfer nips in such a manner that as the image area ratio of a primary toner image increases, the target value (absolute value) of the primary transfer voltage is decreased. When the image forming apparatus has such a configuration, the primary color toner images can be properly transferred onto the intermediate transfer medium without causing the deficient primary transfer problem.

Embodiment H

The feature of the embodiment H is as follows. Specifically, in any one of the embodiments F and G, the primary transfer current output device is characterized by determining the target value of the primary transfer current for primarily transferring one of the color toner images to the intermediate transfer medium so as to be smaller than that for primarily transferring another of the color toner images, which is to be primarily transferred to the intermediate transfer medium before the one of the color toner images is primarily transferred thereto. When the image forming apparatus has such a configuration, occurrence of the reverse translation problem in that a toner image, which is previously transferred onto the intermediate transfer medium, is reversely transferred onto an image bearing member at a primary transfer nip can be prevented.

Embodiment I

The feature of the embodiment I is as follows. Specifically, in any one of the embodiments D-H, the image forming apparatus is characterized in that primary transfer rollers are contacted with the backside of the intermediate transfer medium in such a manner that the primary transfer rollers are located on slightly downstream sides from the image bearing members corresponding to the primary transfer rollers in the moving direction of the intermediate transfer medium to form the primary transfer nips, and the primary transfer current output device is connected with the primary transfer rollers to apply primary transfer currents thereto. When the image forming apparatus has such a configuration, the number of times of occurrence of discharge at a small gap formed at the entrances of the primary transfer nips between the image bearing members and the corresponding primary transfer rollers can be reduced, thereby preventing occurrence of an image scattering problem in that a toner image is scattered due to discharge.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

one or more image bearing members configured to bear different ones of a plurality primary color toner images;

an endless intermediate transfer medium;

a primary transfer device configured to form a primary transfer nip with the intermediate transfer member to form a combined color toner image on the intermediate transfer medium by primarily transferring each of the plurality primary color toner images from the one or more image bearing members to the intermediate transfer medium in a sequence;

a nip forming member contacted with the intermediate transfer medium to form a secondary transfer nip at which the combined color toner image on the intermediate transfer medium is secondarily transferred to a recording sheet; and a transfer current output device configured to apply a transfer current to the secondary transfer nip to secondarily transfer the combined color toner image while determining the secondary transfer current based on image area ratios of the primary color toner images of the combined color toner image using a predetermined algorithm, wherein the secondary transfer current output device is configured such that, when determining the secondary transfer current, the secondary transfer current output device estimates a target value of a transfer current per unit area for each of the plurality of primary color toner images in such a manner that, for each of the plurality of primary color toner images except the last primary color toner image of the sequence, the target value of a transfer current per unit area estimated for secondarily transferring the primary color toner image is not lower than the target value of a transfer current per unit area estimated for secondarily transferring a next one of the primary color toner images in the sequence, and the target value of a transfer current per unit area estimated for secondarily transferring the primary color toner image that is primarily transferred first in the sequence, is higher than the target value of a transfer current per unit area estimated for secondarily transferring the primary color toner image that is primarily transferred last in the sequence, and wherein the secondary transfer current output device is configured to determine the secondary transfer current based on the estimated target values of the transfer currents for all the plurality of primary color toner images.

2. The image forming apparatus according to claim 1, wherein the secondary transfer current output device is configured to estimate a target value of a transfer current per unit area needed for secondarily transferring a non-overlapped area of one of the primary color toner images to be not lower than that needed for secondarily transferring a non-overlapped area of another of the primary color toner images, which is primarily transferred to the intermediate transfer medium next to the one of the color toner images.

3. The image forming apparatus according to claim 2, wherein the secondary transfer current output device is configured to estimate a target value of a transfer current per unit area needed for secondarily transferring an overlapped area of two or more of the primary color toner images based on combinations of the two or more of the primary color toner images.

4. The image forming apparatus according to claim 1, wherein the secondary transfer current output device is configured to determine the secondary transfer current in such a manner that as the image area ratios of the primary color toner images increases, absolute values of the target values of the transfer currents for the primary color toner images increase.

5. The image forming apparatus according to claim 1, including plural image bearing members, wherein the primary transfer device is configured to transfer the primary color toner images to the intermediate transfer medium in such a manner that the primary color toner images on the respective image bearing members are sequentially transferred to the intermediate transfer medium in a predetermined order at respective primary transfer nips to form the combined color toner image thereon, and wherein the image forming apparatus further comprises:

plural primary transfer current output devices configured to apply primary transfer currents to the corresponding primary transfer nips in such a manner that as the image area ratio of a primary color toner image increases, an absolute value of the primary transfer current needed for primarily transferring the primary color toner image decreases.

6. The image forming apparatus according to claim 5, wherein the primary transfer current output devices are configured to apply the primary transfer currents in such a manner that the primary transfer current needed for primarily transferring one of the color toner images to the intermediate transfer medium so as to be greater than that needed for primarily transferring another of the color toner images, which is to be primarily transferred to the intermediate transfer medium next to the one of the color toner images.

7. The image forming apparatus according to claim 5, wherein the primary transfer device includes plural primary transfer rollers contacted with a backside of the intermediate transfer medium in such a manner that the primary transfer rollers are contacted with the corresponding image bearing members with the intermediate transfer medium therebetween while located on downstream sides from the corresponding image bearing members in a moving direction of the intermediate transfer medium to form the primary transfer nips, and wherein the primary transfer current output devices are connected with the corresponding primary transfer rollers.

8. The image forming apparatus according to claim 1, including plural image bearing members, wherein the primary transfer device is configured to transfer the primary color toner images to the intermediate transfer medium in such a manner that the primary color toner images on the respective image bearing members are sequentially transferred to the intermediate transfer medium in a predetermines order at respective primary transfer nips to form the combined color toner image thereon, and wherein the image forming apparatus further comprises:

plural primary transfer current output devices configured to apply primary transfer currents to the corresponding primary transfer nips while performing constant voltage control in such a manner that as the image area ratio of a first primary toner image increases, an absolute value of a primary transfer voltage for primarily transferring the first primary toner image decreases.

9. The image forming apparatus according to claim 8, wherein the primary transfer device includes plural primary transfer rollers contacted with a backside of the intermediate transfer medium in such a manner that the primary transfer rollers are contacted with the corresponding image bearing members with the intermediate transfer medium therebetween while located on downstream sides from the corresponding image bearing members in a moving direction of the intermediate transfer medium to form the primary transfer nips, and wherein the primary transfer current output devices are connected with the corresponding primary transfer rollers.

10. The image forming apparatus according to claim 1, wherein the primary transfer device is configured to primarily transfer the primary color toner images on the one or more image bearing members to the intermediate transfer medium in such a manner that the primary color toner images on respective image bearing members are sequentially transferred to the intermediate transfer medium in a predetermined order at respective primary transfer nips, or in such a manner that the primary color toner images formed on one image bearing member one by one is transferred to the intermediate transfer medium at one primary transfer nip in every rotation cycle of the intermediate transfer medium, to form the combined color toner image on the intermediate transfer medium.

11. The image forming apparatus, according to claim 1, further comprising:

a plurality of image hearing members corresponding, respectively, to the plurality of primary color toner images, the plurality of image bearing members being arranged in an order that corresponds to the sequence, wherein the primary transfer device is configured to transfer each of the plurality primary color toner images from the image bearing members corresponding to the plurality of primary color toner images to the intermediate transfer medium in such a manner that the plurality of primary color toner images are transferred, in the sequence, to the intermediate transfer medium at respective primary transfer nips to form the combined color toner image on the intermediate transfer medium.

12. A method for transferring color toner images, comprising:

forming a combined color toner image on an intermediate transfer medium by primarily transferring each of a plurality of different primary color toner images from one or more image bearing members at a primary transfer nip or at primary transfer nips to the intermediate transfer medium in sequence;

secondarily transferring the combined color toner image to a recording sheet at a secondary transfer nip while applying a transfer current to the secondary transfer nip; and determining the secondary transfer current based on image area ratios of the primary color toner images of the combined color toner image using a predetermined algorithm, wherein the secondary transfer current determining includes estimating a target value of a transfer current per unit area for each of the plurality of primary color toner images in such a manner that, for each of the plurality of primary color toner images except the last primary color toner image of the sequence, the target value of a transfer current per unit area estimated for secondarily transferring the primary color toner image is not lower than the target value of a transfer current per unit area estimated for secondarily transferring a next one of the primary color toner images in the sequence, and the target value of a transfer current per unit area estimated for secondarily transferring the primary color toner image that is primarily transferred first in the sequence, is higher than the target value of a transfer current per unit area estimated for secondarily transferring the primary color toner image that is primarily transferred last in the sequence; and then determining the secondary transfer current based on the estimated target values of the transfer currents for all the plurality of primary color toner images.

13. The method according to claim 12, wherein secondarily transferring the combined color toner image includes estimating a target value of a transfer current per unit area needed for secondarily transferring a non-overlapped area of one of the primary color toner images to he not lower than that needed for secondarily transferring a non-overlapped area of another of the primary color toner images, which is primarily transferred to the intermediate transfer medium next to the one of the color toner images.

14. The method according to claim 13, wherein secondarily transferring the combined color toner image further includes estimating a target value of a transfer current per unit area needed for secondarily transferring an overlapped area of two or more of the primary color toner images based on combinations of the two or more of the primary color toner images.

15. The method according to claim 12, wherein secondarily transferring the combined color toner image includes determining the secondary transfer current in such a manner that as the image area ratios of the primary color toner images increases, absolute values of the target values of the transfer currents for the primary color toner images increase.

16. The method according to claim 12, wherein the one or more image bearing members includes a plurality of image bearing members corresponding, respectively, to the plurality of primary color toner images, wherein the method further comprises:

forming, before the forming the combined color toner image, the plurality of primary color toner images on the corresponding, ones of the plurality of image bearing members respectively, the plurality of image bearing members being arranged in an order that corresponds to the sequence, and wherein the forming the combined color toner image includes transferring each of the plurality primary color toner images from the image bearing members corresponding to the plurality of primary color toner images to the intermediate transfer medium in such a manner that the plurality of primary color toner images are transferred, in the sequence, to the intermediate transfer medium at respective primary transfer nips to form the combined color toner image on the intermediate transfer medium.

* * * * *